United States Patent [19]

Dunn et al.

[11] 4,058,071

[45] Nov. 15, 1977

[54] SEWING MACHINE PRESSER BAR MECHANISM

[75] Inventors: Earl F. Dunn, Edison; Henry Erskine, Somerville, both of N.J.; Edward Hooper, Staten Island, N.Y.

[73] Assignee: The Singer Company, New York, N.Y.

[21] Appl. No.: 753,338

[22] Filed: Dec. 22, 1976

[51] Int. Cl.[2] ..... D05B 29/02

[52] U.S. Cl. ..... 112/235

[58] Field of Search ..... 112/239, 238, 237, 236, 112/235

[56] References Cited

U.S. PATENT DOCUMENTS

| | | | |
|---|---|---|---|
| 2,611,333 | 9/1952 | Ritter | 112/235 |
| 3,793,969 | 2/1974 | Adams | 112/235 |
| 3,863,580 | 2/1975 | Marforio | 112/235 |

*Primary Examiner*—George H. Krizmanich

*Attorney, Agent, or Firm*—Edward L. Bell; Robert E. Smith; Alan Ruderman

[57] ABSTRACT

A low inertia presser bar system for a sewing machine has a short hollow presser bar including a light internal compression spring with an abutment member on top engaged in a depression in the underside of an arm of a fulcrumed bell-crank lever. An upper presser bar having a heavy spring is linked to the upper side of the same arm of the lever. A stop member is threaded into the head of the sewing machine to engage the other arm of the bell-crank lever to oppose and thereby limit the force of the upper spring and isolate the lower spring and presser bar until the lower spring is compressed solid.

10 Claims, 1 Drawing Figure

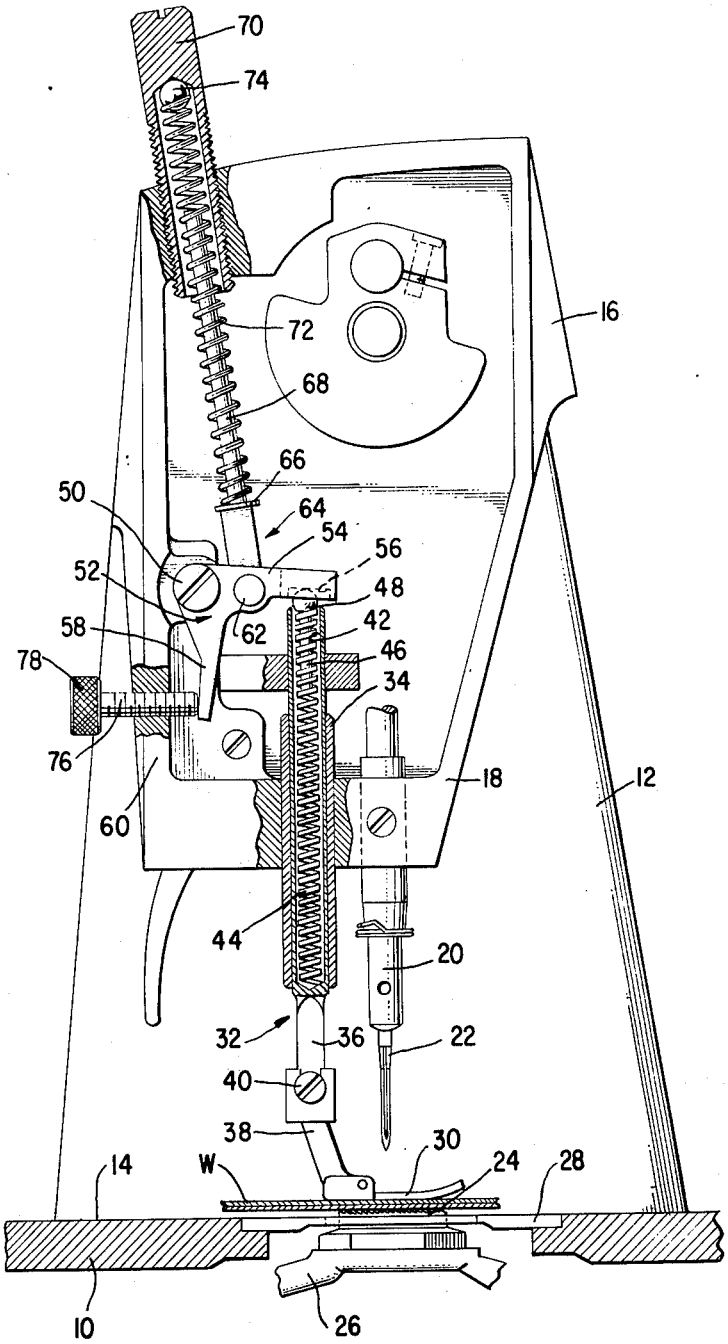
70
74
72
68
66
64
54
56
48
42
46
34
50
52
58
62
78
76
60
16
18
12
44
20
32
36
22
40
38
30
24
28
14
W
10
26

SEWING MACHINE PRESSER BAR MECHANISM

BACKGROUND OF THE INVENTION

This invention relates to sewing machines and more particularly to an improved low inertia presser system therefor and is especially useful for very high speed sewing machines.

In sewing machines having feed dog work feeding mechanism that is raised above the level of a work supporting throat plate, advanced and then dropped beneath the level of the throat plate, a presser mechanism acts to press the plies of the fabric work against the throat plate in cooperation with the feed dog. When the feed dog is above the top surface of the throat plate, it grips the work against the presser foot and lifts the presser foot and presser bar which must also drop with the feed dog until the downward movement of the work is arrested by the throat plate. Thus, the presser mechanism must respond rapidly to and follow the rising and falling movements of the feed dog in order to have effective and proper work feed. Moreover, the presser mechanism must also be capable of readily passing over hems and other obstructions in the material being sewn. As the speed of sewing is increased, it becomes progressively more difficult to return the presser foot quickly and forcably down upon the work at the end of the feed advance cycle of the feed dog. It is therefore desirable that the loads imposed on the feed dog be as light as possible so that the inertia forces acting on the presser mechanism be minimized so as to prevent an upward overthrow of the presser foot after the rise of the feed dog which would result in failure of the presser mechanism to oppose the feed dog consistently during the work advance stroke thereof. A number of low inertia presser devices are known in the art for minimizing these forces. Examples of such devices are illustrated in Ritter, U.S. Pat. No. 2,344,414; Becker, U.S. Pat No. 2,401,216; Ritter, U.S. Pat. No. 2,550,499; Johnson, U.S. Pat. No. 2,616,382; Rockerath, U.S. Pat. No. 2,827,006; Walling, U.S. Pat. No. 3,495,560 and Japanese Utility Model Reg. No. 845,812.

SUMMARY OF THE INVENTION

The present invention is an improvement over the known low inertia presser mechanisms and is especially applicable for high speed sewing machines. The mechanism includes a presser bar journaled in the head of the sewing machine and has a small spring acting between the presser bar and a force transfer member which preferably comprises a pivotable lever against which a second and stronger spring acts in opposition to the first spring. An adjustable member acts in opposition to the stronger spring to limit the extent to which the lever pivots, thereby to isolate the presser bar and smaller spring and to set the desired feeding pressure to be light. There is thus provided a low inertia presser system acting against the feed dog. When sewing over a seam or other obstruction, the small spring will be compressed by this larger force so that the lever is pulled away from the stop and the stronger spring will assist the feed. Thus, during normal feeding only the smaller internal spring in the presser bar is effective with its inherent light pressure and the heavier pressure of the larger spring is available for sewing over seams and other obstructions. The stop member is adjustable so as to regulate the normal feeding pressure and the point at which the larger spring is effective. Consequently, the presser bar with the lighter spring is isolated from the remaining portion of the system to form a low inertia portion until a large force is applied to the presser bar at which time the large spring assists in the feed, and as soon as the large force on the presser bar is removed the low inertia portion provides the lighter pressure required for normal feeding.

Consequently, it is a primary object of the present invention to provide a low inertia presser mechanism for high speed sewing machines in which a light pressure will normally be applied to follow the rising and falling movement of the feed dog and which will apply a larger pressure for readily passing over seams and other obstructions in the material being sewn.

It is another object of the present invention to provide a presser mechanism for sewing machines in which the feeding pressure is normally low for normal feeding of the work so that the presser foot will readily follow the vertical movement of the feed dog, and in which an additional pressure is applied to the work when sewing over obstructions.

It is a further object of the present invention to provide a presser mechanism having first and second resilient members, the first resilient member effective to apply a low pressure to the presser bar and therefore to the work, and the second resilient member effective to apply a high pressure to the work only after the capacity of the first resilient member is exceeded, and an adjustable means for varying the capacity of the first resilient member.

BRIEF DESCRIPTION OF THE DRAWING

The particular features and advantages of the invention as well as other objects will become apparent from the following description taken in connection with the accompanying drawing, in which the sole FIGURE is a head end elevational view of a sewing machine partly in cross section embodying a presser mechanism constructed in accordance with the principles of the present invention.

DETAILED DESCRIPTION OF THE PREFERRED EMBODIMENT

Referring now to the drawing, the present invention is illustrated as embodied in a sewing machine comprising a frame including a bed 10 having a standard 12 upstanding at one end thereof. A work support surface 14 is formed on the top surface of the bed and allows the material that is to be sewn to be manipulated thereon. Extending from the upper end of the standard 12 is a bracket arm 16 which overlies the work support surface and terminates in a sewing head 18 spaced above the work support.

Within the head 18 mounted for endwise reciprocation is a needle bar 20 supporting a needle 22 at its lower end for cooperation in a known manner with a conventional looptaker (not shown) mounted within the bed. The feeding mechanism is illustrated as comprising a feed dog 24 secured on a feed bar 26 and adapted to advance the work W over a throat plate 28. The feed dog is actuated through the usual fourmotion cycle by any conventional mechanism as is well known in the art and as illustrated for example in the aforesaid Walling, U.S. Pat. No. 3,495,560.

The presser mechanism which serves to hold the work down against the throat plate 28 and to hold the work in engagement with the feed dog 24 comprises a presser foot 30 secured to the lower end of a presser bar generally designated as 32 journally supported for endwise movement in a bearing bushing 34 carried in the head of the sewing machine. The presser bar 32 has a lower shank portion 36 to which a shank 38 of the presser foot is secured by means of a shoulder screw 40, and has a hollow 42 formed in the upper remaining portion thereof. Positioned within the hollow 42 is a relatively light coil spring 44 which carries at the top a guide rod 46 having a spherical steel ball 48 at its upper end.

Pivotably mounted about an axis defined by a shoulder screw 50 in the sewing machine is a bell-crank lever generally designated at 52. One arm 54 of the lever 52 is positioned above the presser bar and includes a concave depression 56 for receiving the spherical end 48 of the guide rod 46. The other arm 58 of the bell-crank lever is preferably located adjacent the rear wall 60 of the head 18 of the sewing machine. Positioned on the arm 54 of the bell-crank lever between the axis 50 and the depression 56 is a stud 62 for mounting a guide member 64 having an abutment member 66 at the lever end thereof and includes a guide rod 68 extending upwardly and into a sleeve or busing 70 closed at the upper end and threaded into the top of the head 18. Positioned about the rod 68 is a relatively heavy coil spring 72 having its lower end in engagement with the abutment 66 at which carries a spherical ball 74 at its upper end for abutment with the closed top portion of the sleeve 70.

Threaded into the wall 60 of the head 18 is an adjusting screw 76 having a knurled operator 78 at one end thereof located on the exterior of the head and disposed so that the other end of the screw may abut the leg 58 of the lever 52 to oppose the moment applied to the spring 72.

The low inertia portion of the system is provided by the presser bar 32 the spring 44 the bell-crank 52 and the adjusting screw 76. The spring 44 is much lighter than the main spring 72 which tensions the bell-crank 52 against the adjusting screw 76 and the presser bar (via spherical member 48 and the spring 44). The pressure applied by the main spring 72 can be quite heavy. The internal presser bar spring 44 is set to the desired feeding pressure by adjusting the rear screw 76 thereby varying the position of the bell-crank 52. Thus in normal sewing operation the presser bar 32 and the spring 44 are isolated from the main spring 72 and only the light pressure of the spring 44 acts to assist in feeding. However when an obstacle such as a seam is encountered by the presser foot 30 the spring 44 is compressed solid and the bell-crank 52 is pulled away from the adjusting screw 76. In this case the force of the main spring 72 aids in holding the presser foot 30 properly against the work W to assist the feed dog in feeding. The adjusting screw 76 acts as a stop for the lever 52 and is adjustable to vary the pre-compression of the spring 44 and thereby the force required to compress the spring 44 solid. Thus , adjustment of the screw 76 determines the normal feeding pressure and the pressure at which the spring 72 begins to assist in feed.

The sleeve 70 is threaded into the head 18 of the sewing machine so as to pretension or precompress the spring 72 to apply the appropriate force to the arm 54 of the bell-crank lever 52. Adjustable of the sleeve 70 and of the screw 76 is initially made for the material being sewn and thereafter further adjustment is made by the screw 76. The necessary adjustments for the feeding pressure when a material of a different thickness is to be sewn in a short run is corrected by the adjusting screw 76.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A presser mechanism for a sewing machine having a frame including a head overlying a work support, said mechanism comprising a presser bar having a presser foot on one end slidably journaled for endwise movement in said head, a force transfer member mounted in said head, first resilient means acting between said presser bar and said force transfer member for normally urging said presser bar toward the work support and said member away from the work support, a second resilient means acting between said head and said force transfer member for urging said member toward the work support with a force greater than that of said first resilient means, a stop acting of said force transfer member in opposition to the urging of the second resilient means for limiting the extent to which said member is urged toward the work surface thereby to isolate the presser bar and first resilient means from the second resilient means until a predetermined force on said first resilient means is exceeded, and means for adjusting said stop to change the predetermined force.

2. A presser mechanism as recited in claim 1 wherein said force transfer member comprises a lever, means mounting said lever for pivotable movement about an axis in said head, said first resilient means normally urging said lever to turn in a first direction about said axis, and said second resilient means urging said lever to turn in an opposite direction about said axis.

3. A presser mechanism as recited in claim 2 wherein the action of said second resilient means is nearer to said axis than the action of said first resilient means.

4. A presser mechanism as recited in claim 2 wherein said lever is a bell-crank lever, said first and second resilient means acting on one leg thereof, and said stop means acting on the other leg thereof.

5. A presser mechanism as recited in claim 2 wherein said first resilient means comprises a compression spring, said presser bar having an axially extending hollow for receiving said spring, and means associated with said spring for abutting said lever.

6. A presser mechanism as recited in claim 5 wherein said second resilient means comprises a compression coil spring, a guide member positioned within and abutting one end of said spring and operatively connected to said lever and abutment means in said head for abutting the other end of said coil spring.

7. A presser mechanism as recited in claim 6 wherein said abutment means is adjustable to regulate the compression of said coil spring.

8. A presser mechanism as recited in claim 4 wherein said stop comprises a stud mounted in said sewing machine head, and said means for adjusting said stop comprises cooperating threads on said stud and in said head and an operator fixed to said stud and accessible to advance and retract said stud relative to said head.

9. A presser mechanism as recited in claim 8 wherein said first resilient means comprises a first compression spring and said second resilient means comprises a second compression spring, said presser bar having a hollow for receiving said first spring, means associated with said first spring for operatively abutting said one leg of said lever, a guide member positioned within and abutting one end of said second spring and operatively connected to said one leg of said lever.

10. A presser mechanism as recited in claim 9 wherein said second spring is nearer to said axis than said first spring.

* * * * *